US011721273B2

(12) United States Patent
Cui et al.

(10) Patent No.: US 11,721,273 B2
(45) Date of Patent: Aug. 8, 2023

(54) INFORMATION DISPLAY METHOD, TERMINAL DEVICE, AND STORAGE MEDIUM

(71) Applicant: GUANGDONG OPPO MOBILE TELECOMMUNICATIONS CORP., LTD., Guangdong (CN)

(72) Inventors: Zhijia Cui, Guangdong (CN); Le Yang, Guangdong (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 0 days.

(21) Appl. No.: 17/574,836

(22) Filed: Jan. 13, 2022

(65) Prior Publication Data

US 2022/0139295 A1 May 5, 2022

Related U.S. Application Data

(63) Continuation of application No. PCT/CN2020/113473, filed on Sep. 4, 2020.

(30) Foreign Application Priority Data

Sep. 29, 2019 (CN) ..... 201910934652.5

(51) Int. Cl.
*G09G 3/36* (2006.01)
*G09G 3/20* (2006.01)

(52) U.S. Cl.
CPC ..... *G09G 3/2096* (2013.01); *G09G 3/3618* (2013.01); *G09G 2320/103* (2013.01); *G09G 2340/0435* (2013.01)

(58) Field of Classification Search
CPC ..... G09G 3/2096; G09G 3/3618; G09G 2320/103; G09G 2340/0435
See application file for complete search history.

(56) References Cited

U.S. PATENT DOCUMENTS

2004/0252115 A1 12/2004 Boireau
2008/0100598 A1* 5/2008 Juenger ..... G09G 5/36 345/204

(Continued)

FOREIGN PATENT DOCUMENTS

CN 103514944 1/2014
CN 104731543 6/2015

(Continued)

OTHER PUBLICATIONS

WIPO, International Search Report for PCT/CN2020/113473, dated Dec. 1, 2020.

(Continued)

*Primary Examiner* — Towfiq Elahi
(74) *Attorney, Agent, or Firm* — Hodgson Russ LLP

(57) ABSTRACT

Disclosed are an information display method, a terminal device, and a readable storage medium. The information display method includes: obtaining an information type of each of a plurality of to-be-displayed information; in response to the information type comprising a target information type, obtaining a first refresh frequency of a target to-be-displayed information corresponding to the target information type, and determining a first display frequency of a display screen according to the first refresh frequency; and displaying the plurality of to-be-displayed information according to the first display frequency.

18 Claims, 9 Drawing Sheets

(56) References Cited

U.S. PATENT DOCUMENTS

| | | | | |
|---|---|---|---|---|
| 2008/0143729 | A1 | 6/2008 | Wyatt et al. | |
| 2011/0029921 | A1* | 2/2011 | Terada | G06F 3/0482 715/810 |
| 2013/0141642 | A1 | 6/2013 | Wu et al. | |
| 2014/0208244 | A1* | 7/2014 | Yoo | G06F 16/907 715/764 |
| 2019/0222855 | A1* | 7/2019 | Shekhar | G09G 5/12 |
| 2019/0379860 | A1* | 12/2019 | Matsuda | H04N 9/3111 |

FOREIGN PATENT DOCUMENTS

| | | | | |
|---|---|---|---|---|
| CN | 106412581 | | 2/2017 | |
| CN | 106506856 | | 3/2017 | |
| CN | 109345992 | | 2/2019 | |
| CN | 109767713 | | 5/2019 | |
| CN | 110164356 | A * | 8/2019 | G09G 2/20 |
| CN | 110706675 | | 1/2020 | |
| EP | 3373284 | | 9/2018 | |

OTHER PUBLICATIONS

CNIPA, First Office Action for CN Application No. 201910934652.5, dated Mar. 3, 2021.
CNIPA, Second Office Action for CN Application No. 201910934652.5, dated Jul. 20, 2021.
CNIPA, Third Office Action for CN Application No. 201910934652.5, dated Jan. 4, 2022.
EPO, Extended European Search Report for EP Application No. 20867651.0, dated Aug. 10, 2022.
CNIPA, Rejection Decision for CN Application No. 201910934652.5, dated Jul. 5, 2022.

* cited by examiner

INFORMATION DISPLAY METHOD, TERMINAL DEVICE, AND STORAGE MEDIUM

CROSS REFERENCE

The present application is a continuation of International Patent Application No. PCT/CN2020/113473, filed on Sep. 4, 2020, which claims priority to Chinese Patent Application No. 201910934652.5, filed on Sep. 29, 2019, the entire disclosures of which are incorporated herein by reference.

TECHNICAL FIELD

The present disclosure relates to the field of electronic device technologies, and in particular to an information display method, a terminal device, and a storage medium.

BACKGROUND

Conventionally, as shown in FIG. 1-2B, a display process of a display screen is that a processor sends to-be-displayed information to the display screen, and the to-be-displayed information is transmitted through the relevant protocol. In addition, there is an instruction signal between the display screen and the processor, the processor may control a display of the display screen through the instruction signal, and the display screen may notify the processor of a current display status through the instruction signal.

SUMMARY OF THE DISCLOSURE

In an aspect, the present disclosure provides an information display method, comprising: obtaining an information type of each of a plurality of to-be-displayed information; in response to the information type comprising a target information type, obtaining a first refresh frequency of a target to-be-displayed information corresponding to the target information type, and determining a first display frequency of a display screen according to the first refresh frequency; and displaying the plurality of to-be-displayed information according to the first display frequency.

In another aspect, the present disclosure provides a terminal device, comprising: a memory, a processor, and a computer program stored in the memory and executable by the processor; wherein the processor implements the information display method as described above when executing the computer program.

In further another aspect, the present disclosure provides a non-transitory computer readable storage medium, storing a computer program; wherein the computer program is executable by a processor to implement the information displaying method as described above.

The additional aspects and advantages of the present disclosure will be partly given in the following description, and some will become obvious from the following description, or be understood through the practice of the present disclosure.

BRIEF DESCRIPTION OF THE DRAWINGS

The above and/or additional aspects and advantages of the present disclosure will become obvious and easy to understand from the following description of the embodiments in conjunction with the accompanying drawings.

DETAILED DESCRIPTION

Figure 1:
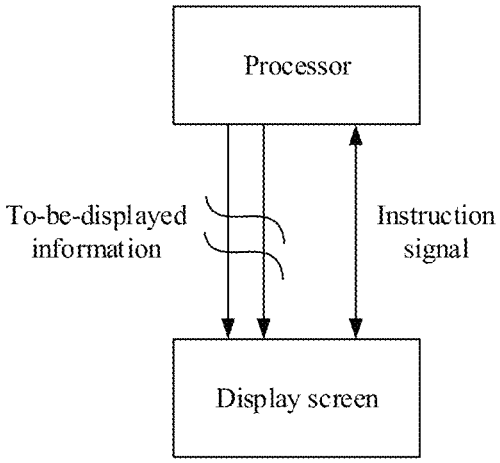
FIG. 1 is a schematic view of display interaction between a processor and a display screen according to related art.
Figure 2A:
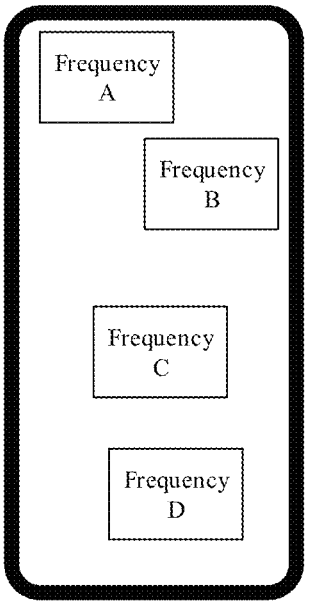
FIG. 2A is a schematic view of a display information display interface according to related art.
Figure 2B:
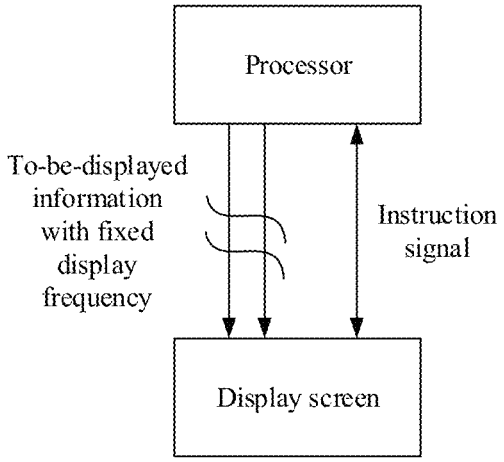
FIG. 2B a schematic view of another display interaction between a processor and a display screen according to related art.

The embodiments of the present disclosure are described in detail below. Examples of the embodiments are shown in the accompanying drawings, wherein same or similar reference numerals indicate same or similar elements or elements with same or similar functions. The embodiments described below with reference to the drawings are exemplary, and are intended to explain the present disclosure, but should not be understood as a limitation to the present disclosure.

Figure 3:
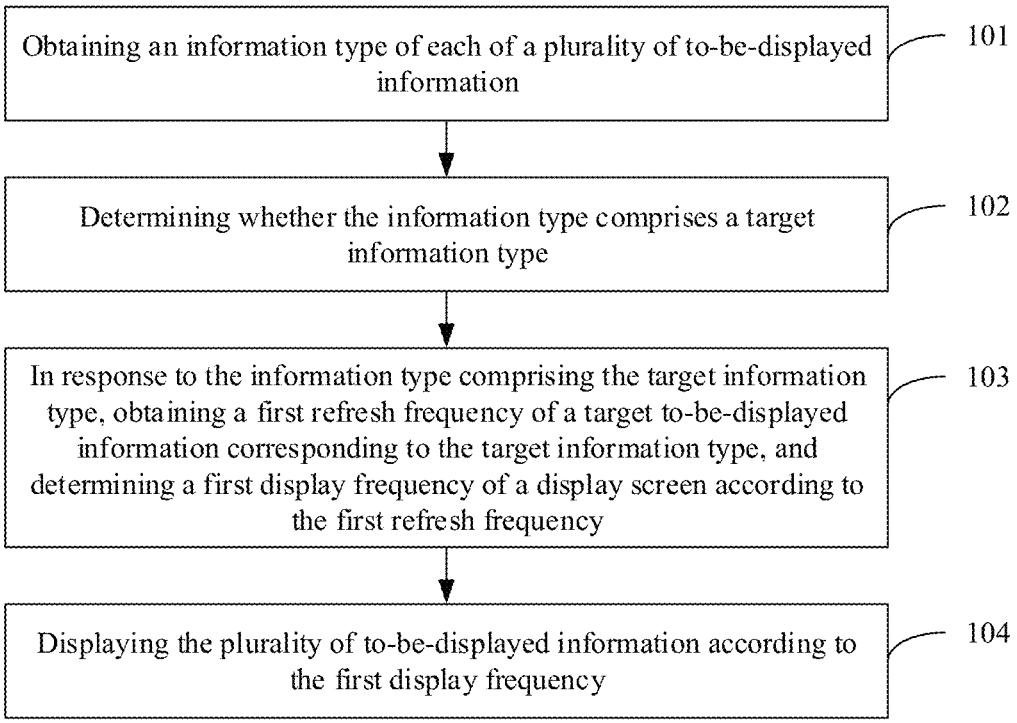
FIG. 3 is a flowchart of an information display method according to an embodiment of the present disclosure.

Referring to FIG. 3, the information display method of embodiments of the present disclosure includes operations at blocks as followed.

At block 101: obtaining an information type of each of a plurality of to-be-displayed information.

At block 102: determining whether the information type comprises a target information type.

At block 103: in response to the information type comprising the target information type, obtaining a first refresh frequency of a target to-be-displayed information corresponding to the target information type, and determining a first display frequency of a display screen according to the first refresh frequency.

At block 104: displaying the plurality of to-be-displayed information according to the first display frequency.

In some embodiments, in response to the information type comprising the target information type, the obtaining the first refresh frequency of the target to-be-displayed information corresponding to the target information type, and the determining the first display frequency of the display screen according to the first refresh frequency include: determining whether the number of the target to-be-displayed information is greater than 1; in response to the number of the target to-be-displayed information being greater than 1, determining whether the first refresh frequencies corresponding to the plurality of target to-be-displayed information are the same; and in response to the first refresh frequencies corresponding to the plurality of target to-be-displayed information being not the same, calculating a first least common multiple of the first refresh frequencies to obtain the first display frequency.

In some embodiments, after the determining whether the number of the target to-be-displayed information is greater than 1, the method further includes: in response to the number of the target to-be-displayed information being 1, determining that the first refresh frequency is the first display frequency.

In some embodiments, before the displaying the plurality of to-be-displayed information according to the first display frequency, the method further includes: in response to the first display frequency being greater than a preset display frequency, adjusting the first display frequency to the preset display frequency.

Figure 4:
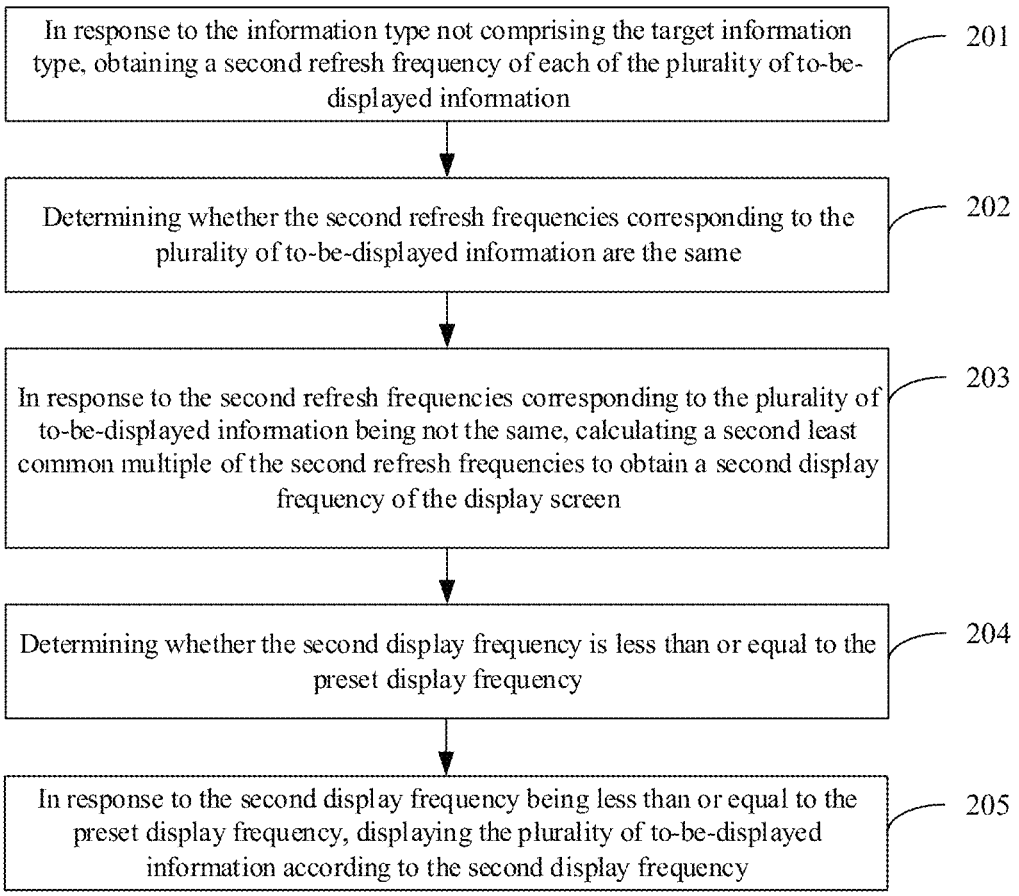
FIG. 4 is a flowchart of an information display method according to another embodiment of the present disclosure.

Referring to FIG. 4, in some embodiments, after the determining whether the information type comprises the target information type, the method further includes operations at blocks as followed.

At block 201: in response to the information type not comprising the target information type, obtaining a second refresh frequency of each of the plurality of to-be-displayed information.

At block 202: determining whether the second refresh frequencies corresponding to the plurality of to-be-displayed information are the same.

At block 203: in response to the second refresh frequencies corresponding to the plurality of to-be-displayed information being not the same, calculating a second least common multiple of the second refresh frequencies to obtain a second display frequency of the display screen.

At block 204: determining whether the second display frequency is less than or equal to the preset display frequency.

At block 205: in response to the second display frequency being less than or equal to the preset display frequency, displaying the plurality of to-be-displayed information according to the second display frequency.

In some embodiments, after the determining whether the second display frequency is less than or equal to the preset display frequency, the method further includes: in response to the second display frequency being greater than the preset display frequency, determining a maximum second refresh frequency among the second refresh frequencies; determining a third display frequency of the display screen from the preset display frequency and the maximum second refresh frequency, according to a magnitude relationship between the preset display frequency and the maximum second refresh frequency; and displaying the plurality of to-be-displayed information according to the third display frequency.

In some embodiments, the determining the third display frequency of the display screen from the preset display frequency and the maximum second refresh frequency, according to the magnitude relationship between the preset display frequency and the maximum second refresh frequency includes: determining whether the maximum second refresh frequency is greater than or equal to the preset display frequency; in response to the maximum second refresh frequency being greater than or equal to the preset display frequency, determining that the preset display frequency is the third display frequency; and in response to the maximum second refresh frequency being less than or equal to the preset display frequency, determining that the maximum second refresh frequency is the third display frequency.

In some embodiments, before the displaying the plurality of to-be-displayed information according to the third display frequency, the method further includes: obtaining a rendering mode corresponding to each of the plurality of to-be-displayed information; determining whether the rendering mode comprises a central processor rendering mode; in response to the rendering mode comprising the central processor rendering mode, rendering the to-be-displayed information corresponding to the central processor rendering mode according to the third display frequency.

Figure 8:
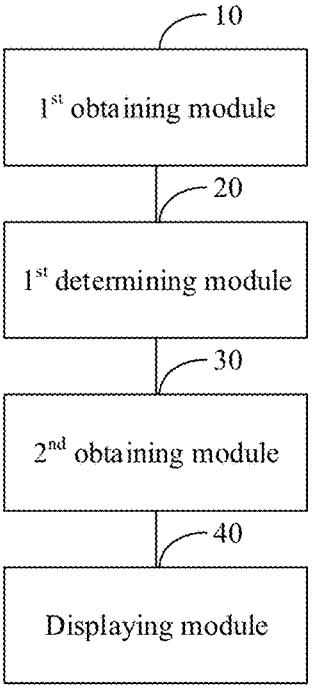
FIG. 8 is a structural schematic view of an information display apparatus according to an embodiment of the present disclosure.

Referring to FIGS. 3 and 8, the information display apparatus of embodiments of the present disclosure includes a first obtaining module 10, a first determining module 20, a second obtaining module 30, and a display module 40. The first obtaining module 10 is configured to obtain an information type of each of a plurality of to-be-displayed information; the first determining module 20 is configured to determine whether the information type comprises a target information type; the second obtaining module 30 is configured to, in response to the information type comprising the target information type, obtain a first refresh frequency of a target to-be-displayed information corresponding to the target information type, and determine a first display frequency of a display screen according to the first refresh frequency; the display module 40 is configured to display the plurality of to-be-displayed information according to the first display frequency.

Figure 9:
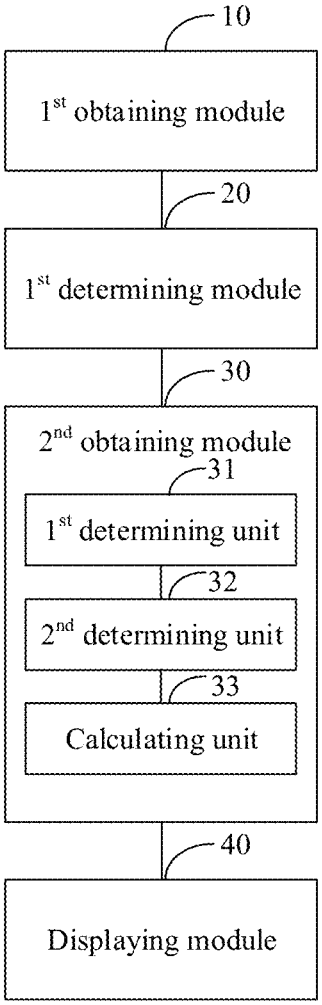
FIG. 9 is a structural schematic view of an information display apparatus according to another embodiment of the present disclosure.

Referring to FIG. 9, in some embodiments, the second obtaining module 30 further includes a first determining unit 31, a second determining unit 32, and a calculating unit 33. The first determining unit 31 is configured to determine whether the number of the target to-be-displayed information is greater than 1; the second determining unit 32 is configured to, in response to the number of the target to-be-displayed information being greater than 1, determine whether the first refresh frequencies corresponding to the plurality of target to-be-displayed information are the same; the calculating unit 33 is configured to, in response to the first refresh frequencies corresponding to the plurality of target to-be-displayed information being not the same, calculate a first least common multiple of the first refresh frequencies to obtain the first display frequency.

Figure 10:
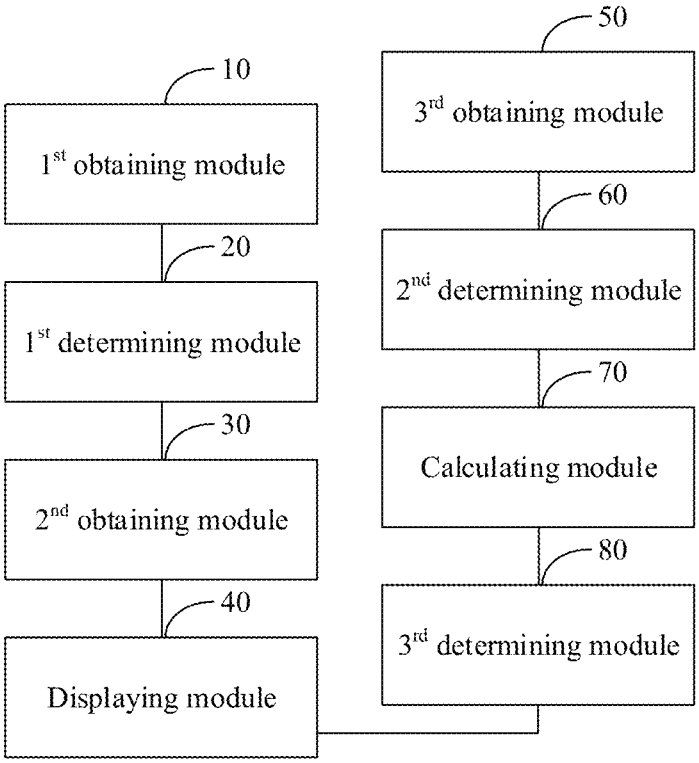
FIG. 10 is a structural schematic view of an information display apparatus according to further another embodiment of the present disclosure.

Referring to FIG. 10, in some embodiments, the information display apparatus further includes a third obtaining module 50, a second determining module 60, a calculating module 70, and a third determining module 80. The third obtaining module 50 is configured to, in response to the information type not comprising the target information type, obtain a second refresh frequency of each of the plurality of to-be-displayed information; the second determining module 60 is configured to determine whether the second refresh frequencies corresponding to the plurality of to-be-displayed information are the same; the calculating module 70 is configured to, in response to the second refresh frequencies corresponding to the plurality of to-be-displayed information being not the same, calculate a second least common multiple of the second refresh frequencies to obtain a second display frequency of the display screen; the third determining module 80 is configured to determine whether the second display frequency is less than or equal to the preset display frequency; the display module 40 is further configured to, in response to the second display frequency being less than or equal to the preset display frequency, display the plurality of to-be-displayed information according to the second display frequency.

Figure 11:
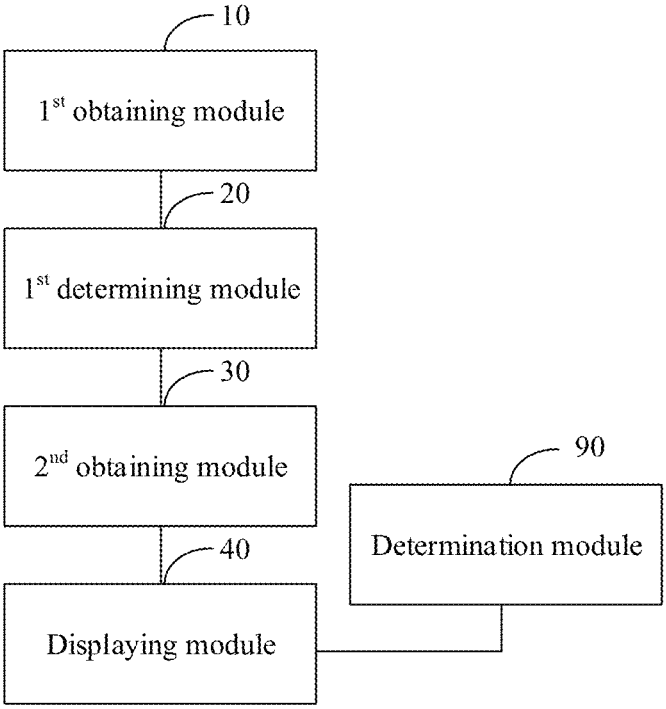
FIG. 11 is a structural schematic view of an information display apparatus according to further another embodiment of the present disclosure.

Referring to FIG. 11, in some embodiments, the information display apparatus further includes a determination module 90. The determination module 90 is configured to, in response to the second display frequency being greater than the preset display frequency, determine a maximum second refresh frequency among the second refresh frequencies; the determination module 90 is further configured to determine a third display frequency of the display screen from the preset display frequency and the maximum second refresh frequency, according to a magnitude relationship between the preset display frequency and the maximum second refresh frequency; the display module 40 is further configured to display the plurality of to-be-displayed information according to the third display frequency.

Figure 12:
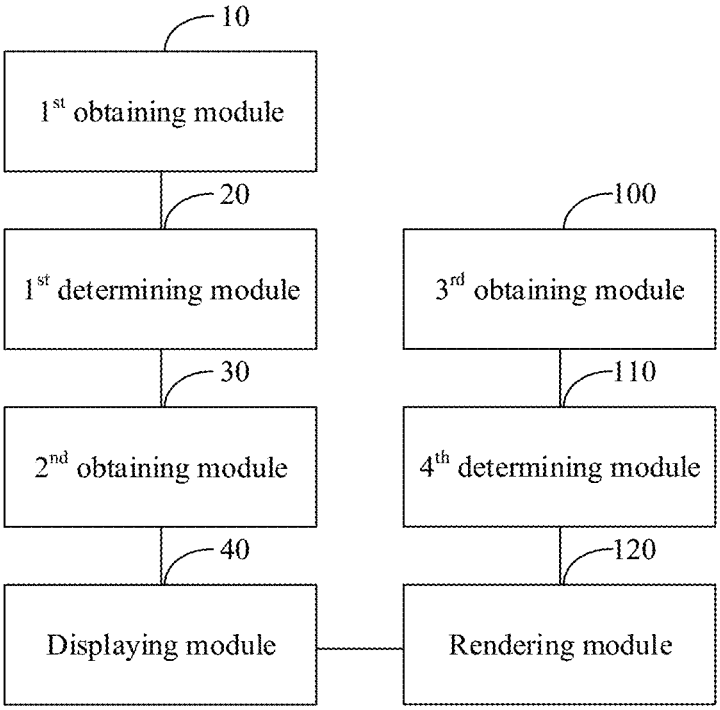
FIG. 12 is a structural schematic view of an information display apparatus according to further another embodiment of the present disclosure.

Referring to FIG. 12, in some embodiments, the information display apparatus further includes a third obtaining module 100, a fourth determining module 110, and a rendering module 120. The third obtaining module 100 is configured to obtain a rendering mode corresponding to each of the plurality of to-be-displayed information; the fourth determining module 110 is configured to determine whether the rendering mode comprises a central processor rendering mode; the rendering module 120 is configured to, in response to the rendering mode comprising the central processor rendering mode, render the to-be-displayed information corresponding to the central processor rendering mode according to the third display frequency.

Figure 13:
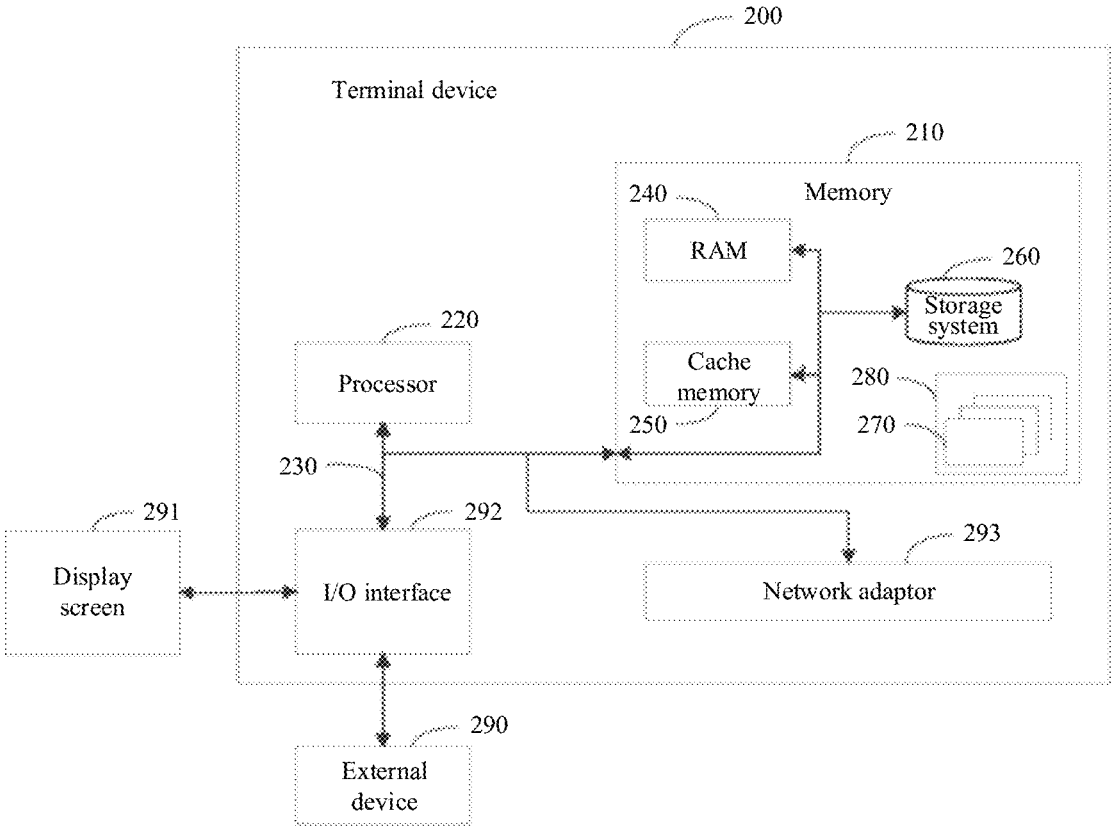
FIG. 13 is a structural schematic view of a terminal device according to an embodiment of the present disclosure.

Referring to FIGS. 3 and 13, the terminal device 200 in embodiments of the present disclosure includes a memory 210, a processor 220, and a computer program stored in the memory 210 and executable on the processor 220. When the processor 220 executes the computer program, an information display method may be achieved: obtaining an information type of each of a plurality of to-be-displayed information; determining whether the information type comprises a target information type; in response to the information type comprising the target information type, obtaining a first refresh frequency of a target to-be-displayed information corresponding to the target information type, and determining a first display frequency of a display screen according to the first refresh frequency; and displaying the plurality of to-be-displayed information according to the first display frequency.

In some embodiments, in response to the information type comprising the target information type, the obtaining the first refresh frequency of the target to-be-displayed information corresponding to the target information type, and the determining the first display frequency of the display screen according to the first refresh frequency include: determining whether the number of the target to-be-displayed information is greater than 1; in response to the number of the target to-be-displayed information being greater than 1, determining whether the first refresh frequencies corresponding to the plurality of target to-be-displayed information are the same; and in response to the first refresh frequencies corresponding to the plurality of target to-be-displayed information being not the same, calculating a first least common multiple of the first refresh frequencies to obtain the first display frequency.

In some embodiments, after the determining whether the number of the target to-be-displayed information is greater than 1, the method further includes: in response to the number of the target to-be-displayed information being 1, determining that the first refresh frequency is the first display frequency.

In some embodiments, before the displaying the plurality of to-be-displayed information according to the first display frequency, the method further includes: in response to the first display frequency being greater than a preset display frequency, adjusting the first display frequency to the preset display frequency.

Referring to FIG. 4, in some embodiments, after the determining whether the information type comprises the target information type, the method further includes: in response to the information type not comprising the target information type, obtaining a second refresh frequency of each of the plurality of to-be-displayed information; determining whether the second refresh frequencies corresponding to the plurality of to-be-displayed information are the same; in response to the second refresh frequencies corresponding to the plurality of to-be-displayed information being not the same, calculating a second least common multiple of the second refresh frequencies to obtain a second display frequency of the display screen; determining whether the second display frequency is less than or equal to the preset display frequency; and in response to the second display frequency being less than or equal to the preset display frequency, displaying the plurality of to-be-displayed information according to the second display frequency.

In some embodiments, after the determining whether the second display frequency is less than or equal to the preset display frequency, the method further includes: in response to the second display frequency being greater than the preset display frequency, determining a maximum second refresh frequency among the second refresh frequencies; determining a third display frequency of the display screen from the preset display frequency and the maximum second refresh frequency, according to a magnitude relationship between the preset display frequency and the maximum second refresh frequency; and displaying the plurality of to-be-displayed information according to the third display frequency.

In some embodiments, the determining the third display frequency of the display screen from the preset display frequency and the maximum second refresh frequency, according to the magnitude relationship between the preset display frequency and the maximum second refresh frequency includes: determining whether the maximum second refresh frequency is greater than or equal to the preset display frequency; in response to the maximum second refresh frequency being greater than or equal to the preset display frequency, determining that the preset display frequency is the third display frequency; and in response to the maximum second refresh frequency being less than or equal to the preset display frequency, determining that the maximum second refresh frequency is the third display frequency.

In some embodiments, before the displaying the plurality of to-be-displayed information according to the third display frequency, the method further includes: obtaining a rendering mode corresponding to each of the plurality of to-be-displayed information; determining whether the rendering mode comprises a central processor rendering mode; in response to the rendering mode comprising the central processor rendering mode, rendering the to-be-displayed information corresponding to the central processor rendering mode according to the third display frequency.

A non-transitory computer-readable storage medium according to embodiments of the present disclosure has a computer program stored thereon. When the computer program is executed by a processor, the information display method described in any one of the above embodiments is implemented. The information display method and apparatus according to the embodiments of the present disclosure will be described below with reference to the accompanying drawings.

As mentioned in the section Background, the display screen may display multiple to-be-displayed information at the same time. For example, when a user is watching a video in a small screen mode, the display screen may display comment information, navigation bar information, video information, etc. at the same time. Each to-be-displayed information has a corresponding refresh frequency. When multiple refresh frequencies do not match the display frequency of the display screen, phenomenon of frame loss, repeated frame, or freeze will occur. For example, if the display information is refreshed in a display interval of the display frequency, frame loss will occur.

Therefore, in order to solve the above technical problems, the present disclosure proposes an optimized information display method to ensure the smooth display of display information and balance the display power consumption of the display screen.

Specifically, FIG. 3 is a flowchart of an information display method according to an embodiment of the present disclosure.

As shown in FIG. 3, the information display method includes the following steps:

At block 101: obtaining an information type of each of a plurality of to-be-displayed information.

At block 102: determining whether the information type comprises a target information type.

It should be understood that in many application scenarios, the display screen corresponds to multiple to-be-displayed information, which may include static display content such as comment information, or dynamic display content such as video. Obviously, the user will be more sensitive to the smoothness of the dynamic display content. Therefore, for improving the viewing experience, in the embodiments, the information type of each of the plurality of to-be-displayed information is obtained, so as to further determine the display frequency according to the display type.

Furthermore, it is determined whether the target information type is included in the information type. The target information type may refer to the above-mentioned dynamic display type, or may be any user-defined information type.

It should be noted that in different application scenarios, the way to obtain the information type of each to-be-displayed information is different. Examples are as followed.

Example 1

In this example, an information type recognition model is trained in advance according to a large amount of sample data, each to-be-displayed information is input into a corresponding recognition model, and the information type corresponding to each to-be-displayed information is determined.

Example 2

In this example, a handle of a display layer corresponding to each to-be-displayed information is extracted, and the corresponding information type is determined based on a keyword of the handle.

Example 3

In this example, a display control of the corresponding layer in each to-be-displayed information is obtained, and the corresponding information type is determined according to a centralized type of the display control. For example, display controls corresponding to the current to-be-displayed information are basically video controls, then the information type is a dynamic information type.

At block 103: in response to the information type comprising the target information type, obtaining a first refresh frequency of a target to-be-displayed information corresponding to the target information type, and determining a first display frequency of a display screen according to the first refresh frequency.

At block 104: displaying the plurality of to-be-displayed information according to the first display frequency.

Specifically, when the target information type is included, it is considered necessary to give priority to the display fluency of the target to-be-displayed information corresponding to the target information type. Specifically, the first refresh frequency of the to-be-displayed information is determined and the first display frequency is determined according to the first refresh frequency. Further, the plurality of to-be-displayed information is displayed according to the first display frequency.

It should be understood that the refresh frequency may be construed as the refresh rate of the to-be-displayed information, such as the refresh rate of the layer where it is located, and the display frequency may be construed as the display frequency of a display clock of the display screen. The display frequency determines the speed of transmitting the to-be-displayed information to the display. The processor transmits corresponding to-be-displayed information to the display screen according to the display frequency, so as to realize the display of the to-be-displayed information on the display screen.

The first refresh frequency is set in advance according to information content of the to-be-displayed information. For example, the manufacturer of the to-be-displayed information sets the first refresh frequency that meets a standard according to industry standards. A corresponding relationship between the first refresh frequency and the to-be-displayed information may be determined in advance according to the industry standards. In this way, based on query to the corresponding information, the first refresh frequency of the target to-be-displayed information corresponding to the target information type is determined.

It should be noted that in different application scenarios, the method of determining the first display frequency of the display screen according to the first refresh frequency is different.

As a possible implementation, it is determined whether the number of target to-be-displayed information is greater than 1, and when the number of target to-be-displayed information is 1, the first refresh frequency is directly taken as the first display frequency. In this way, the plurality of to-be-displayed information is displayed according to the first display frequency, which can ensure the smoothness of the displayed target to-be-displayed information. When the number of target to-be-displayed information is greater than 1, that is, there are multiple target to-be-displayed information, then taking into account the multiple target to-be-displayed information, it is determined whether the first refresh frequencies corresponding to the multiple target to-be-displayed information are the same. When the first refresh frequencies are the same, the multiple to-be-displayed information is displayed directly based on the first refresh frequency as the final first display frequency.

In this example, when the first refresh frequencies corresponding to the multiple target to-be-displayed information are not the same, a first least common multiple of the first refresh frequencies is calculated to obtain the first display frequency. Therefore, the first display frequency is calculated according to the first least common multiple of the first refresh frequencies, and the different first display frequencies may be adapted such that each first refresh frequency coincides with the corresponding first display frequency. In this way, the target to-be-displayed information may not lose frames or repeat frames, ensuring the smooth display of the target to-be-displayed information and balancing the display power consumption of the display screen.

As another possible implementation, after the first refresh frequency is obtained, when there are multiple and different first refresh frequencies, a largest first refresh frequency may be directly obtained as the final first display frequency for displaying.

Of course, in the embodiments of the present disclosure, it is necessary to determine whether the first display frequency is less than or equal to a preset display frequency. The preset display frequency may be determined according to the remaining power of the terminal device where the current display screen is located, or the preset display frequency may be an achievable maximum display frequency of the display screen. When the first display frequency is less than or equal to the preset display frequency, the plurality of to-be-displayed information is displayed according to the first display frequency. When the first display frequency is greater than the preset display frequency, the first display frequency is adjusted to the preset display frequency to ensure that the smooth display of the target to-be-displayed information can be supported to the greatest extent.

In some embodiments of the present disclosure, when the target information type is not included in the possible information types, the refresh frequency of each to-be-displayed information is taken into consideration to determine the final display frequency of the display screen.

Specifically, as shown in FIG. 4, after the operation 102, the method further includes operations at blocks as followed.

At block 201: in response to the information type not comprising the target information type, obtaining a second refresh frequency of each of the plurality of to-be-displayed information.

Specifically, in the same manner as the method of obtaining the first refresh frequency, in order to take into account the display fluency of the plurality of to-be-displayed information, the second refresh frequency of each to-be-displayed information is obtained.

At block 202: determining whether the second refresh frequencies corresponding to the plurality of to-be-displayed information are the same.

At block 203: in response to the second refresh frequencies corresponding to the plurality of to-be-displayed information being not the same, calculating a second least common multiple of the second refresh frequencies to obtain a second display frequency of the display screen.

Specifically, it is determined whether the second refresh frequencies corresponding to the plurality of to-be-displayed information are the same. When the second refresh frequencies are not the same, the second least common multiple of the second refresh frequencies is calculated to obtain the second display frequency of the display screen. For example, when the second refresh frequencies are 30 HZ and 24 HZ, the least common multiple of the two is calculated to obtain the second display frequency of 120 HZ as the second display frequency.

In the embodiments, when the second refresh frequencies are the same, the second refresh frequency is taken as the second display frequency of the display screen.

At block 204: determining whether the second display frequency is less than or equal to the preset display frequency.

Similarly, the preset display frequency in the embodiments may be determined according to the remaining power of the terminal device where the display screen is currently located, or may be the maximum display frequency that the display screen can achieve.

At block 205: in response to the second display frequency being less than or equal to the preset display frequency, displaying the plurality of to-be-displayed information according to the second display frequency.

Specifically, when the second display frequency is less than or equal to the preset frequency, the plurality of to-be-displayed information are displayed directly according to the second display frequency. Therefore, each second refresh frequency coincides with the second display frequency, ensuring the display fluency of each to-be-displayed information. In addition, the second display frequency calculated based on the second least common multiple balances the power consumption of the display screen.

In some embodiments of the present disclosure, when the second display frequency is greater than the preset display frequency, in order to ensure that the smooth display of the to-be-displayed information can be supported to the greatest extent, a largest second refresh frequency among the second refresh frequencies is determined, Furthermore, a third display frequency of the display screen is determined from the preset display frequency and the maximum second refresh frequency, according to a magnitude relationship between the preset display frequency and the maximum second refresh frequency. It can be understood that the maximum second refresh frequency refers to a maximum value among the second refresh frequencies. As a possible implementation, it is determined whether the maximum second refresh frequency is greater than or equal to the preset display frequency. When the maximum second refresh frequency is greater than or equal to the preset display frequency, the preset display frequency is determined as the third display frequency. When the maximum second refresh frequency is less than or equal to the preset display frequency, the maximum second refresh frequency is determined to be the third display frequency. That is, the maximum value among the preset display frequency and the maximum second refresh frequency is determined as the third display frequency. The plurality of to-be-displayed information is displayed according to the third display frequency. Since the third display frequency is relatively large, it can overlap with the second refresh frequencies to the greatest extent, and the display fluency of the plurality of to-be-displayed information is ensured to a greater extent.

It is not difficult to understand that when the rendering method of the to-be-displayed information is to obtain resource refresh directly based on the network, for example, the comment information is directly read from the server, then the to-be-displayed information may be obtained based on network resources with the display frequency of the to-be-displayed information. When the rendering method of the to-be-displayed information is the central processor rendering method, obviously the second refresh frequency refers to the rendering frequency of the central processor. Many game interfaces that need to be rendered by the central processor can only obtain corresponding to-be-displayed information at the corresponding display frequency after the central processor has finished rendering. Therefore, in some embodiments of the present disclosure, the rendering speed of the central processor is adapted to the third display frequency in order to ensure that the corresponding to-be-displayed information can be displayed at the third display frequency.

Specifically, in the embodiments, the rendering mode corresponding to each to-be-displayed information is obtained. The rendering mode may be determined according to the information type of the to-be-displayed information, etc., and it is determined whether the rendering mode includes the central processor rendering mode. When the central processor rendering mode is included, the to-be-displayed information corresponding to the central processor rendering mode is rendered according to the third display frequency.

Based on the above embodiments, on the basis of having priority to ensure the smoothness of the display of the target information type, the refresh frequency of the target information type is first considered before determining the display frequency of the display to make a better balance between the smoothness of the display and power consumption.

In order to make the information display method of the embodiments of the present disclosure clearer to those skilled in the art, the following describes two specific application scenarios as examples.

Scene 1:

In this scenario, the to-be-displayed information is A and B, and the corresponding refresh frequencies are a and b, where a is greater than b, the target information type is the video type, and the preset display frequency is the maximum display frequency that the display screen can support.

Figure 5:
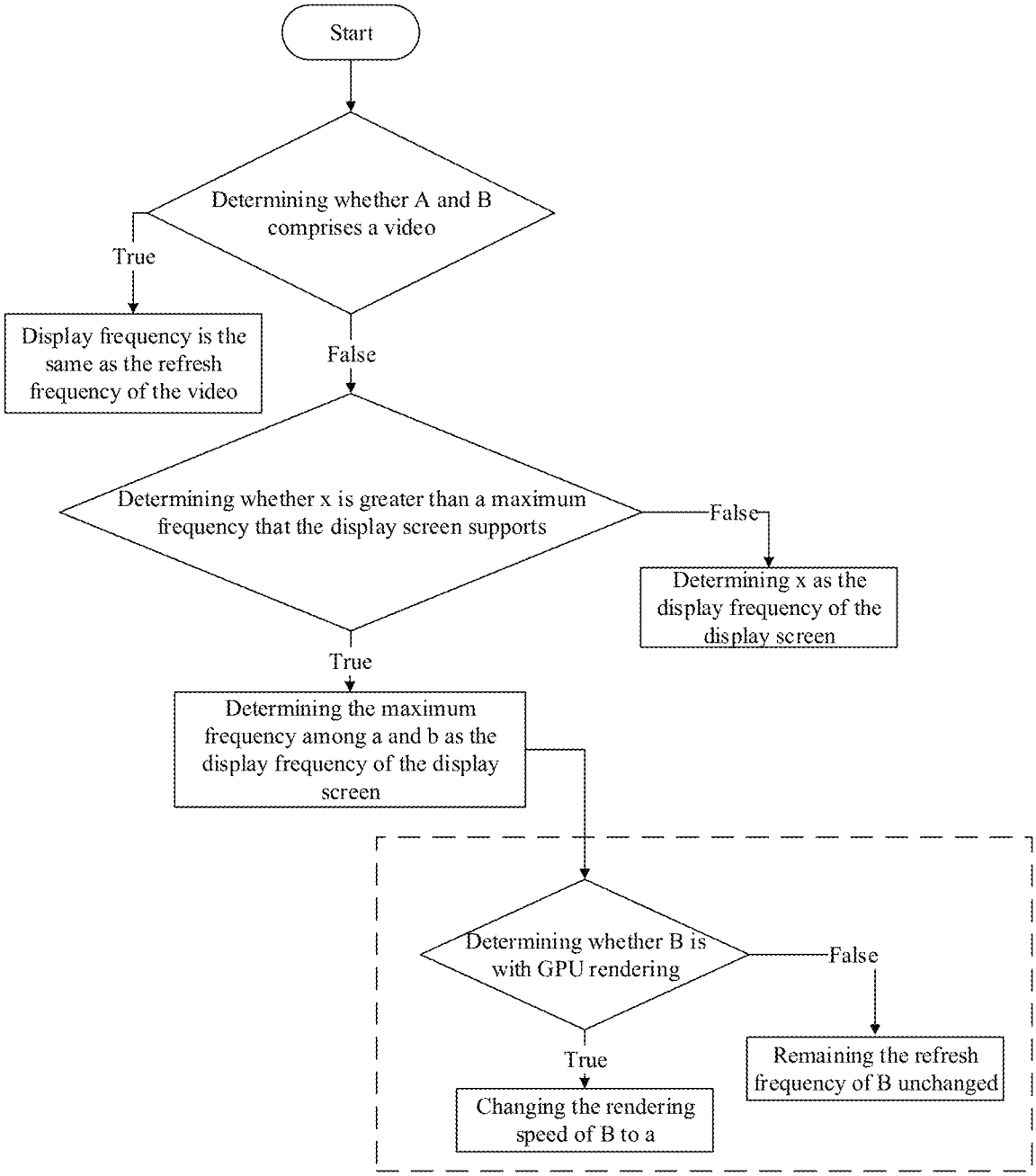
FIG. 5 is a flowchart of an information display method according to further another embodiment of the present disclosure.

As shown in FIG. 5, it is determined whether the to-be-displayed information A and B includes a video. When the video exists, the refresh frequency corresponding to the video is taken as the display frequency of the display screen to display the to-be-displayed information A and B. For example, the to-be-displayed information A is a video, and the refresh frequency a is taken as the display frequency of the display screen.

When the to-be-displayed information A and B includes no video, the least common multiple x of the refresh frequencies a and b is obtained, and it is determined whether x is greater than the maximum display frequency that the display screen can support. When x is less than or equal to the maximum display frequency that the display can support, x is taken as the display frequency of the display screen. When x is greater than the maximum display frequency that the display can support, the maximum value a among the refresh frequencies a and b is taken as the display frequency of the display screen. It is determined whether the to-be-displayed information B is with the GPU rendering mode of the central processor. When the to-be-displayed information B is with the GPU rendering mode of the central processor, the rendering speed of the to-be-displayed information B is increased to a for drawing. When the to-be-displayed information B is not the GPU rendering mode of the central processor, the refresh frequency of the to-be-displayed information B is not changed.

Scene 2:

In this scenario, the to-be-displayed information is A, B, C, and the corresponding refresh frequencies are a, b, and c, where a is greater than b, b is greater than c, the target information type is video type, and the preset display frequency is the maximum display frequency that the display screen can support.

Figure 6:
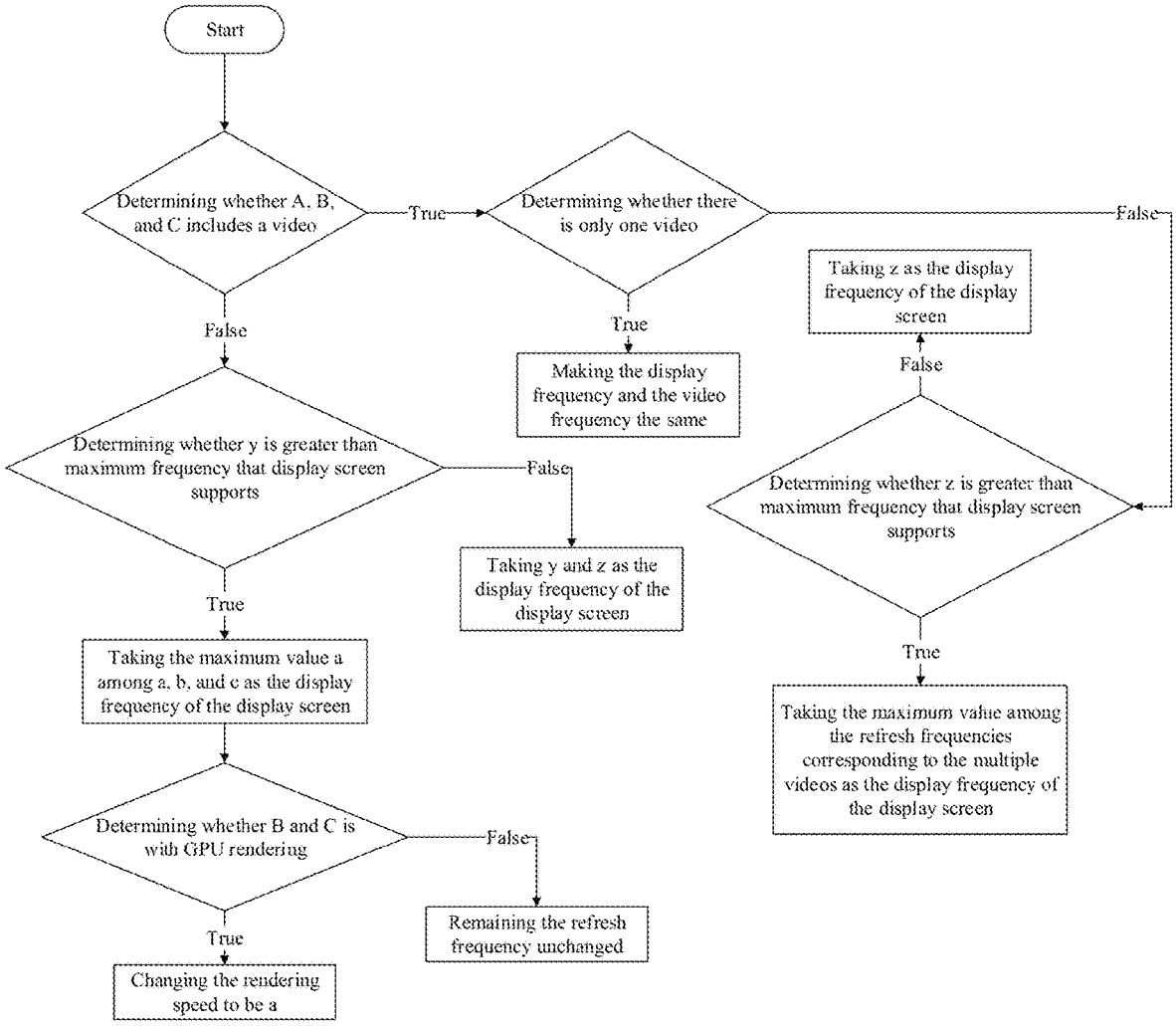
FIG. 6 is a flowchart of an information display method according to further another embodiment of the present disclosure.

As shown in FIG. 6, it is determined whether the to-be-displayed information A, B, and C includes a video. When no video exists, it is determined whether the least common multiple y of the refresh frequencies a, b, and c is greater than the maximum display frequency that the display can support. When y is less than or equal to the maximum display frequency that the display screen can support, y is taken as the display frequency of the display screen. When y is greater than the maximum display frequency that the display screen can support, the maximum value a of the refresh frequencies a, b and c is taken as the display frequency of the display screen. It is determined whether the GPU rendering mode of the central processor is included in the to-be-displayed information B and C. When the GPU rendering mode of the central processor is included, the corresponding rendering speed is directly changed to a. When the GPU rendering mode of the central processor is not included, the refresh frequency of the to-be-displayed information is not changed.

In this example, when the to-be-displayed information A, B, and C includes a video, it is determined whether the number of videos is one. If the number of videos is one, in order to ensure the smooth display of the video animation, the refresh frequency of the video is taken as the display frequency of the to-be-displayed information A, B and C on the display screen. When the number of videos is greater than one, it is determined whether the least common multiple z of the refresh frequencies corresponding to the videos is greater than the maximum display frequency that the display screen can support. When z is less than or equal to the maximum display frequency that the display screen can support, the least common multiple z is taken as the display frequency of the to-be-displayed information A, B, C on the display screen. When z is greater than the maximum display frequency that the display screen can support, the maximum value of the refresh frequencies corresponding to the videos is taken as display frequency of the to-be-displayed information A, B, C on the display screen.

Figure 7:
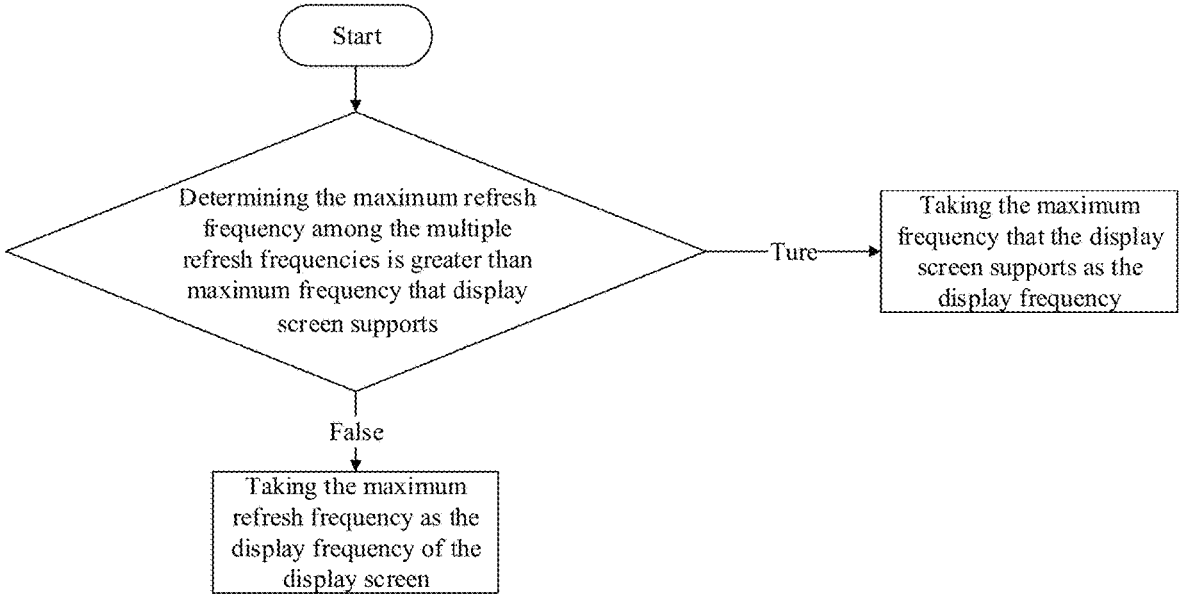
FIG. 7 is a flowchart of an information display method according to further another embodiment of the present disclosure.

Based on the above embodiments, without prioritizing the display fluency of the target information type, as shown in FIG. 7, it is determined whether the maximum refresh frequency among the refresh frequencies of the plurality of to-be-displayed information is greater than or equal to the preset display frequency. The preset display frequency may be construed as the maximum display frequency supported by the display. When the maximum refresh frequency among the refresh frequencies is greater than or equal to the preset display frequency, the plurality of to-be-displayed information may be displayed at the preset display frequency to ensure the display fluency of the plurality of to-be-displayed information. When the maximum refresh frequency among the refresh frequencies is less than or equal to the preset display frequency, the plurality of to-be-displayed information may be displayed at the maximum refresh frequency among the refresh frequencies to balance the display power consumption of the display screen while ensuring the smooth display of the plurality of to-be-displayed information.

In summary, the information display method of the embodiments of the present disclosure includes: obtaining an information type of each of a plurality of to-be-displayed information; determining whether the information type comprises a target information type; in response to the information type comprising the target information type, obtaining a first refresh frequency of a target to-be-displayed information corresponding to the target information type, and determining a first display frequency of a display screen according to the first refresh frequency; and displaying the plurality of to-be-displayed information according to the first display frequency. In this way, when multiple to-be-displayed information is included, priority is given to ensuring smooth and complete display of the to-be-displayed information for a specific information type, and the power consumption during information display is balanced, thereby solving the technical problem of information display lag, repeated display or frame loss in the related art.

In order to implement the above embodiments, the present disclosure also proposes an information display apparatus.

FIG. 8 is a structural schematic view of an information display apparatus according to an embodiment of the present disclosure.

As shown in FIG. 8, the information display apparatus includes: a first obtaining module 10, a first determining module 20, a second obtaining module 30 and a display module 40.

The first obtaining module 10 is configured to obtain an information type of each of a plurality of to-be-displayed information.

The first determining module 20 is configured to determine whether the information type comprises a target information type.

The second obtaining module 30 is configured to, in response to the information type comprising the target information type, obtain a first refresh frequency of a target to-be-displayed information corresponding to the target information type, and determine a first display frequency of a display screen according to the first refresh frequency.

The display module 40 is configured to display the plurality of to-be-displayed information according to the first display frequency.

Further, in a possible implementation manner of the embodiments of the present disclosure, as shown in FIG. 9, on the basis of FIG. 8, the second obtaining module 30 includes: a first determining unit 31, a second determining unit 32, and a calculating unit 33.

The first determining unit 31 is configured to determine whether the number of the target to-be-displayed information is greater than 1.

The second determining unit 32 is configured to, in response to the number of the target to-be-displayed information being greater than 1, determine whether the first refresh frequencies corresponding to the plurality of target to-be-displayed information are the same.

The calculating unit 33 is configured to, in response to the first refresh frequencies corresponding to the plurality of target to-be-displayed information being not the same, calculate a first least common multiple of the first refresh frequencies to obtain the first display frequency.

In a possible implementation manner of the embodiments of the present disclosure, as shown in FIG. 10, on the basis of FIG. 8, the device further includes: a third obtaining module 50, a second determining module 60, and a calculating module 70, and a third determining module 80.

The third obtaining module 50 is configured to, in response to the information type not comprising the target information type, obtain a second refresh frequency of each of the plurality of to-be-displayed information.

The second determining module 60 is configured to determine whether the second refresh frequencies corresponding to the plurality of to-be-displayed information are the same.

The calculating module 70 is configured to, in response to the second refresh frequencies corresponding to the plurality of to-be-displayed information being not the same, calculate a second least common multiple of the second refresh frequencies to obtain a second display frequency of the display screen.

The third determining module 80 is configured to determine whether the second display frequency is less than or equal to the preset display frequency.

In the embodiments, the display module 40 is further configured to, in response to the second display frequency being less than or equal to the preset display frequency, display the plurality of to-be-displayed information according to the second display frequency.

In a possible implementation manner of the embodiments of the present disclosure, as shown in FIG. 11, on the basis of FIG. 8, the device further includes: a determination module 90.

The determination module 90 is configured to, in response to the second display frequency being greater than the preset display frequency, determine a maximum second refresh frequency among the second refresh frequencies.

The determination module 90 is further configured to determine a third display frequency of the display screen from the preset display frequency and the maximum second refresh frequency, according to a magnitude relationship between the preset display frequency and the maximum second refresh frequency.

In the embodiments, the display module 40 is further configured to display the plurality of to-be-displayed information according to the third display frequency.

In a possible implementation manner of the embodiments of the present disclosure, as shown in FIG. 12, on the basis of FIG. 8, the device further includes: a third obtaining module 100, a fourth determining module 110, and a rendering module 120.

The third obtaining module 100 is configured to obtain a rendering mode corresponding to each of the plurality of to-be-displayed information.

The fourth determining module 110 is configured to determine whether the rendering mode comprises a central processor rendering mode.

The rendering module 120 is configured to, in response to the rendering mode comprising the central processor rendering mode, render the to-be-displayed information corresponding to the central processor rendering mode according to the third display frequency.

It should be noted that the foregoing explanation of the embodiments of the information display method is also applicable to the information display apparatus of the embodiments, and will not be repeated here.

In summary, the information display apparatus of the embodiments of the present disclosure may perform: obtaining an information type of each of a plurality of to-be-displayed information; determining whether the information type comprises a target information type; in response to the information type comprising the target information type, obtaining a first refresh frequency of a target to-be-displayed information corresponding to the target information type, and determining a first display frequency of a display screen according to the first refresh frequency; and displaying the plurality of to-be-displayed information according to the first display frequency. In this way, when multiple to-be-displayed information is included, priority is given to ensuring smooth and complete display of the to-be-displayed information for a specific information type, and the power consumption during information display is balanced, thereby solving the technical problem of information display lag, repeated display or frame loss in the related art.

In order to implement the above embodiments, the present disclosure also proposes a terminal device.

FIG. 13 is a structural schematic view of a terminal device according to an embodiment of the present disclosure.

As shown in FIG. 13, the terminal device 200 includes: a memory 210, a processor 220, and a bus connected to different components (including the memory 210 and the processor 220). The memory 210 stores computer programs. When the processor 220 executes the programs, the terminal device-based data processing method according to the embodiments of the present disclosure is implemented.

The bus 230 represents one or more of several types of bus structures, including a memory bus or a memory controller, a peripheral bus, a graphics acceleration port, a processor, or a local bus using any bus structure among multiple bus structures. For example, these architectures include, but are not limited to, industry standard architecture (ISA) bus, micro-channel architecture (MAC) bus, enhanced ISA bus, video electronics standards association (VESA) local bus, and peripheral component interconnection (PCI) bus.

The terminal device 200 typically includes a variety of terminal device readable medium. The medium may be any available medium that can be accessed by the terminal device 200, including volatile and non-volatile medium, removable and non-removable medium.

The memory 210 may also include a computer system readable medium in the form of volatile memory, such as random access memory (RAM) 240 and/or cache memory 250. The terminal device 200 may further include other removable/non-removable, volatile/nonvolatile computer system storage medium. For example, the storage system 260 may be configured to read and write non-removable, non-volatile magnetic medium (not shown in FIG. 13 and generally referred to as a "hard drive"). Although not shown in FIG. 13, disk drives may be provided for reading and writing to removable non-volatile disks (e.g., "floppy disks") and optical disk drives for reading and writing to removable non-volatile optical disks (e.g., CD ROM DVD ROM or other optical media). In these cases, each drive may be connected to the bus 230 through one or more data medium interfaces. The memory 210 may include at least one program product, and the program product has a set of (for example, at least one) program module, and the program module is configured to perform the functions of the embodiments of the present disclosure.

A program/utility tool 280 having a set of (at least one) program module 270 may be stored in, for example, the memory 210. Such program module 270 includes, but is not limited to, an operating system, one or more application programs, and other program modules and program data, each of these examples or some combination may include the realization of a network environment. The program module 270 generally executes the functions and/or methods in the embodiments described in the present disclosure.

The terminal device 200 may also communicate with one or more external devices 290 (for example, a keyboard, a pointing device, a display 291, etc.), and may also communicate with one or more devices that enable a user to interact with the terminal device 200, and/or communicate with any device (such as a network card, modem, etc.) that enables the terminal device 200 to communicate with one or more other computing devices. Such communication may be performed through an input/output (I/O) interface 292. In addition, the terminal device 200 may also communicate with one or more networks (for example, a local area network (LAN), a wide area network (WAN), and/or a public network, such as the Internet) through a network adapter 293. As shown in the figure, the network adapter 293 communicates with other modules of the terminal device 200 through the bus 230. It should be understood that although not shown in the figure, other hardware and/or software modules can be used in conjunction with the terminal device 200, including but not limited to: microcode, device drivers, redundant processors, external disk drive arrays, RAID systems, tape drives, data backup storage systems, etc.

The processor 220 executes various functional applications and data processing by running programs stored in the memory 210.

It should be noted that, for the implementation process and technical principles of the terminal device of the embodiments, reference may be made to the foregoing explanation of the data processing method based on the terminal device of the embodiments of the present disclosure, which will not be repeated here.

In order to implement the above-mentioned embodiments, the present disclosure also proposes a non-transitory computer-readable storage medium.

The non-transitory computer-readable storage medium has a computer program stored thereon, and when the program is executed by a processor, the information display method described in the embodiments of the present disclosure is realized.

In an optional implementation form, the embodiments may adopt any combination of one or more computer-readable medium. The computer-readable medium may be a computer-readable signal medium or a computer-readable storage medium. The computer-readable storage medium may be, for example, but not limited to, an electrical, magnetic, optical, electromagnetic, infrared, or semiconductor system, apparatus, or component, or any combination of the above. More specific examples (non-exhaustive list) of computer-readable storage medium include: electrical connections with one or more wires, portable computer disks, hard disks, random access memory (RAM), read-only memory (ROM), erasable programmable read-only memory (EPROM or flash memory), optical fiber, portable compact disk read-only memory (CD-ROM), optical storage device, magnetic storage device, or any suitable combination of the above. In this document, the computer-readable storage medium may be any tangible medium that contains or stores a program, and the program can be used by or in combination with an instruction execution system, apparatus, or device.

The computer-readable signal medium may include a data signal propagated in baseband or as a part of a carrier wave, and computer-readable program code is carried therein. The propagated data signal may take many forms, including, but not limited to, electromagnetic signals, optical signals, or any suitable combination of the foregoing. The computer-readable signal medium may also be any computer-readable medium other than a computer-readable storage medium. The computer-readable medium may send, propagate, or transmit programs for use by or in combination with the instruction execution system, apparatus, or device.

The program code contained in the computer-readable medium may be transmitted by any suitable medium, including, but not limited to, wireless, wire, optical cable, RF, etc., or any suitable combination of the above.

The computer program code configured to perform the operations of the present disclosure may be written in one or more programming languages or a combination thereof. The programming languages include object-oriented programming languages, such as Java, Smalltalk, C++, and also conventional procedural programming language, such as "C" language or similar programming languages. The program code may be completely executed on the user terminal device, partly executed on the user terminal device, executed as an independent software package, partly executed on the user terminal device and partly executed on the remote terminal device, or completely executed on the remote terminal device or executed on the server. In the case of remote terminal device, the remote terminal device may be connected to the user terminal device through any kind of network including a local area network (LAN) or a wide area network (WAN), or may be connected to an external terminal device (e.g. using an Internet service provider to connect via the Internet).

Other embodiments of the present disclosure will readily come to the mind of those skilled in the art upon consideration of the specification and practice of the present disclosure as applied for herein. The present disclosure is intended to cover any variation, use, or adaptation of the present disclosure that follows the general principles of the present disclosure and includes commonly known or customary technical means in the art not applied for herein. The specification and embodiments are to be considered exemplary only, and the true scope and spirit of the present disclosure is indicated by the claims.

It should be understood that the present disclosure is not limited to the precise structure that has been described above and shown in the drawings, and various modifications and changes may be made without departing from its scope. The scope of the present disclosure is only limited by the appended claims.

What is claimed is:

1. An information display method, comprising:

obtaining an information type of each of a plurality of to-be-displayed information;

in response to the information type comprising a target information type, obtaining a first refresh frequency of a target to-be-displayed information corresponding to the target information type, and determining a first display frequency of a display screen according to the first refresh frequency; and displaying the plurality of to-be-displayed information according to the first display frequency;

in response to the information type not comprising the target information type, obtaining a second refresh frequency of each of the plurality of to-be-displayed information;

in response to the second refresh frequencies corresponding to the plurality of to-be-displayed information being not the same, calculating a second least common multiple of the second refresh frequencies to obtain a second display frequency of the display screen; and in response to the second display frequency being less than or equal to a preset display frequency, displaying the plurality of to-be-displayed information according to the second display frequency.

2. The information display method according to claim 1, wherein in response to the information type comprising the target information type, the obtaining the first refresh frequency of the target to-be-displayed information corresponding to the target information type, and the determining the first display frequency of the display screen according to the first refresh frequency comprise:

in response to the target to-be-displayed information comprising a plurality of target to-be-displayed information, and in response to the plurality of first refresh frequencies corresponding to the plurality of target to-be-displayed information being not the same, calculating a first least common multiple of the plurality of first refresh frequencies to obtain the first display frequency.

3. The information display method according to claim 2, further comprising:

in response to the target to-be-displayed information not comprising the plurality of target to-be-displayed information, determining that the first refresh frequency is the first display frequency.

4. The information display method according to claim 1, before the displaying the plurality of to-be-displayed information according to the first display frequency, further comprising:

in response to the first display frequency being greater than a preset display frequency, adjusting the first display frequency to the preset display frequency.

5. The information display method according to claim 1, further comprising:

in response to the second display frequency being greater than the preset display frequency, determining a maximum second refresh frequency among the second refresh frequencies;

determining a third display frequency of the display screen from the preset display frequency and the maximum second refresh frequency, according to a magnitude relationship between the preset display frequency and the maximum second refresh frequency; and displaying the plurality of to-be-displayed information according to the third display frequency.

6. The information display method according to claim 5, wherein the determining the third display frequency of the display screen from the preset display frequency and the maximum second refresh frequency, according to the magnitude relationship between the preset display frequency and the maximum second refresh frequency comprises:

in response to the maximum second refresh frequency being greater than or equal to the preset display frequency, determining that the preset display frequency is the third display frequency; and in response to the maximum second refresh frequency being less than or equal to the preset display frequency, determining that the maximum second refresh frequency is the third display frequency.

7. The information display method according to claim 5, before the displaying the plurality of to-be-displayed information according to the third display frequency, further comprising:

obtaining a rendering mode corresponding to each of the plurality of to-be-displayed information; and in response to the rendering mode comprising a central processor rendering mode, rendering the to-be-displayed information corresponding to the central processor rendering mode according to the third display frequency.

8. The information display method according to claim 4, wherein the preset display frequency is a maximum display frequency that the display screen supports; or the preset display frequency is determined by a remaining power of the terminal device.

9. A terminal device, comprising: a memory, a processor, and a computer program stored in the memory and executable by the processor; wherein the processor implements an information display method when executing the computer program, the information display method comprising:

obtaining an information type of each of a plurality of to-be-displayed information;

determining whether the information type comprises a target information type;

in response to the information type comprising the target information type, obtaining a first refresh frequency of a target to-be-displayed information corresponding to the target information type, and determining a first display frequency of a display screen according to the first refresh frequency; and displaying the plurality of to-be-displayed information according to the first display frequency;

in response to the information type not comprising the target information type, obtaining a second refresh frequency of each of the plurality of to-be-displayed information;

in response to the second refresh frequencies corresponding to the plurality of to-be-displayed information being not the same, calculating a second least common multiple of the second refresh frequencies to obtain a second display frequency of the display screen; and in response to the second display frequency being less than or equal to a preset display frequency, displaying the plurality of to-be-displayed information according to the second display frequency.

10. The terminal device according to claim 9, wherein in response to the information type comprising the target information type, the obtaining the first refresh frequency of the target to-be-displayed information corresponding to the target information type, and the determining the first display frequency of the display screen according to the first refresh frequency comprise:

determining whether the target to-be-displayed information comprises a plurality of target to-be-displayed information;

in response to the target to-be-displayed information comprising the plurality of target to-be-displayed information, determining whether a plurality of first refresh frequencies corresponding to the plurality of target to-be-displayed information are the same; and in response to the plurality of first refresh frequencies corresponding to the plurality of target to-be-displayed information being not the same, calculating a first least common multiple of the plurality of first refresh frequencies to obtain the first display frequency.

11. The terminal device according to claim 10, wherein after the determining whether the target to-be-displayed information comprises the plurality of target to-be-displayed information, the method further comprises:

in response to the target to-be-displayed information not comprising the plurality of target to-be-displayed information, determining that the first refresh frequency is the first display frequency.

12. The terminal device according to claim 9, wherein before the displaying the plurality of to-be-displayed information according to the first display frequency, the method further comprises:

in response to the first display frequency being greater than a preset display frequency, adjusting the first display frequency to the preset display frequency.

13. The terminal device according to claim 9, wherein after the determining whether the second display frequency is less than or equal to the preset display frequency, the method further comprises:

in response to the second display frequency being greater than the preset display frequency, determining a maximum second refresh frequency among the second refresh frequencies;

determining a third display frequency of the display screen from the preset display frequency and the maximum second refresh frequency, according to a magnitude relationship between the preset display frequency and the maximum second refresh frequency; and displaying the plurality of to-be-displayed information according to the third display frequency.

14. The terminal device according to claim 13, wherein the determining the third display frequency of the display screen from the preset display frequency and the maximum second refresh frequency, according to the magnitude relationship between the preset display frequency and the maximum second refresh frequency comprises:

determining whether the maximum second refresh frequency is greater than or equal to the preset display frequency;

in response to the maximum second refresh frequency being greater than or equal to the preset display frequency, determining that the preset display frequency is the third display frequency; and in response to the maximum second refresh frequency being less than or equal to the preset display frequency, determining that the maximum second refresh frequency is the third display frequency.

15. The terminal device according to claim 13, wherein before the displaying the plurality of to-be-displayed information according to the third display frequency, the method further comprises:

obtaining a rendering mode corresponding to each of the plurality of to-be-displayed information;

determining whether the rendering mode comprises a central processor rendering mode; and in response to the rendering mode comprising the central processor rendering mode, rendering the to-be-displayed information corresponding to the central processor rendering mode according to the third display frequency.

16. The terminal device according to claim 9, wherein the preset display frequency is a maximum display frequency that the display screen supports.

17. The terminal device according to claim 9, wherein the preset display frequency is determined by a remaining power of the terminal device.

18. A non-transitory computer readable storage medium, storing a computer program; wherein the computer program is executable by a processor to perform:

obtaining an information type of each of a plurality of to-be-displayed information;

in response to the information type comprising a target information type, obtaining a first refresh frequency of a target to-be-displayed information corresponding to the target information type, and determining a first display frequency of a display screen according to the first refresh frequency; and displaying the plurality of to-be-displayed information according to the first display frequency;

in response to the information type not comprising the target information type, obtaining a second refresh frequency of each of the plurality of to-be-displayed information;

in response to the second refresh frequencies corresponding to the plurality of to-be-displayed information being not the same, calculating a second least common multiple of the second refresh frequencies to obtain a second display frequency of the display screen; and in response to the second display frequency being less than or equal to a preset display frequency, displaying the plurality of to-be-displayed information according to the second display frequency.

* * * * *